US006634194B1

(12) United States Patent
Watkins

(10) Patent No.: US 6,634,194 B1
(45) Date of Patent: Oct. 21, 2003

(54) WASHING MACHINE OVERFLOW SYSTEM

(75) Inventor: Derek Lee Watkins, Elizabethtown, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/475,593

(22) Filed: Feb. 8, 2000

(51) Int. Cl.[7] ..... D06F 39/08
(52) U.S. Cl. ..... 68/147; 68/208
(58) Field of Search ..... 680/13 R, 18 R, 680/23 A, 147, 157, 171, 208

(56) References Cited

U.S. PATENT DOCUMENTS 3,159,174 A * 12/1964 Searle et al.
3,390,554 A * 7/1968 Morgan
3,494,152 A * 2/1970 Pick
3,612,095 A 10/1971 Beare
3,675,448 A 7/1972 Smith
3,774,418 A 11/1973 Ohmann
3,785,181 A * 1/1974 Menk
3,828,199 A * 8/1974 Sakai et al.
3,863,467 A * 2/1975 Pielemeier et al.
4,184,347 A * 1/1980 Tobita et al.
4,202,187 A * 5/1980 Hukuzawa et al.
4,231,130 A * 11/1980 Tobita et al.
4,317,343 A 3/1982 Gerry
4,372,134 A * 2/1983 Matsuo
4,930,552 A 6/1990 Estep
5,167,722 A * 12/1992 Pastryk et al.
5,307,649 A * 5/1994 Lim et al.
5,315,727 A * 5/1994 Lee
5,517,833 A 5/1996 Mustee et al.

FOREIGN PATENT DOCUMENTS

JP 2-255184 * 10/1990

* cited by examiner

*Primary Examiner*—Frankie L. Stinson
(74) *Attorney, Agent, or Firm*—George L. Rideout, Jr.; Armstrong Teasdale LLP

(57) ABSTRACT

An overflow system for a washing machine includes a plurality of vents attached to a top of a washing machine tub. The vents extend through a sidewall of the tub and collect water in collector members extending from an exterior of the tub. When a depth of water inside the tub exceeds a top of the collector members, water is discharged from the collector members through open tops of the collector member to a portion of a tub exterior distanced from a washing machine drive and motor assembly.

17 Claims, 3 Drawing Sheets

WASHING MACHINE OVERFLOW SYSTEM

BACKGROUND OF THE INVENTION

This invention relates generally to washing machines, and, more particularly, to an overflow system for a washing machine.

Washing machines typically include a cabinet that houses an outer tub for containing wash and rinse water, a perforated clothes basket within the tub, and an agitator within the basket. A drive and motor assembly is mounted underneath the stationary outer tub to rotate the clothes basket and the agitator relative to one another, and a pump assembly pumps water from the tub to a drain. See, for example, U.S. Pat. No. 4,317,343.

If water overflowing from the tub reaches the drive and motor assembly below the tub, the drive and motor assembly may be damaged, leading to repair or possibly replacement of the machine. Overflow of the tub can occur for many reasons, including, but not limited to, a water fill timer sticking and failing to advance out of a fill position, failure of a pressure switch in a pressure fill machine, a blocked pump or kinked drain hose leading to failure to remove a previous fill before a new one is initiated, a stuck water valve, and operator error in manually interrupting a pump out cycle and initiating a fill cycle.

Accordingly, it would be desirable to provide an overflow system for a washing machine that avoids damage to the drive and motor assembly in an overflow situation.

BRIEF SUMMARY OF THE INVENTION

In an exemplary embodiment of the invention, an overflow system for a washing machine includes a tub with at least one vent extending through a sidewall of the tub, and at least one collector member attached to the sidewall and forming an enclosure adjacent the vent. When a depth of water inside the tub reaches a pre-selected level, water passes through the vent and into the enclosure formed by the collector member. An open top of the enclosure allows water to spill over the collector member and run down an exterior surface of the tub to a bottom of the tub to prevent overflow of the top of the tub.

During normal operation of the machine, water splashing through the vent from an interior of the tub is contained in the collector member by a top portion of the collector member and the splashed water pools in a bottom portion of the collector member. A return passage extends below the vent adjacent the bottom portion of the collector member and allows water to flow back into the tub for reuse. In a potential overflow situation, water flows through the vent into the collector member enclosure when a depth of water inside the tub equals a selected depth determined by the position of the vent. As the water depth increases and exceeds a selected depth determined by the position of the upper portion of the collector member, water spills over the collector member and runs down a selected portion of the tub exterior away from the drive and motor assembly. Water is therefore prevented from spilling over the top of the tub and damaging the drive and motor assembly.

DETAILED DESCRIPTION OF THE INVENTION

Figure 1:
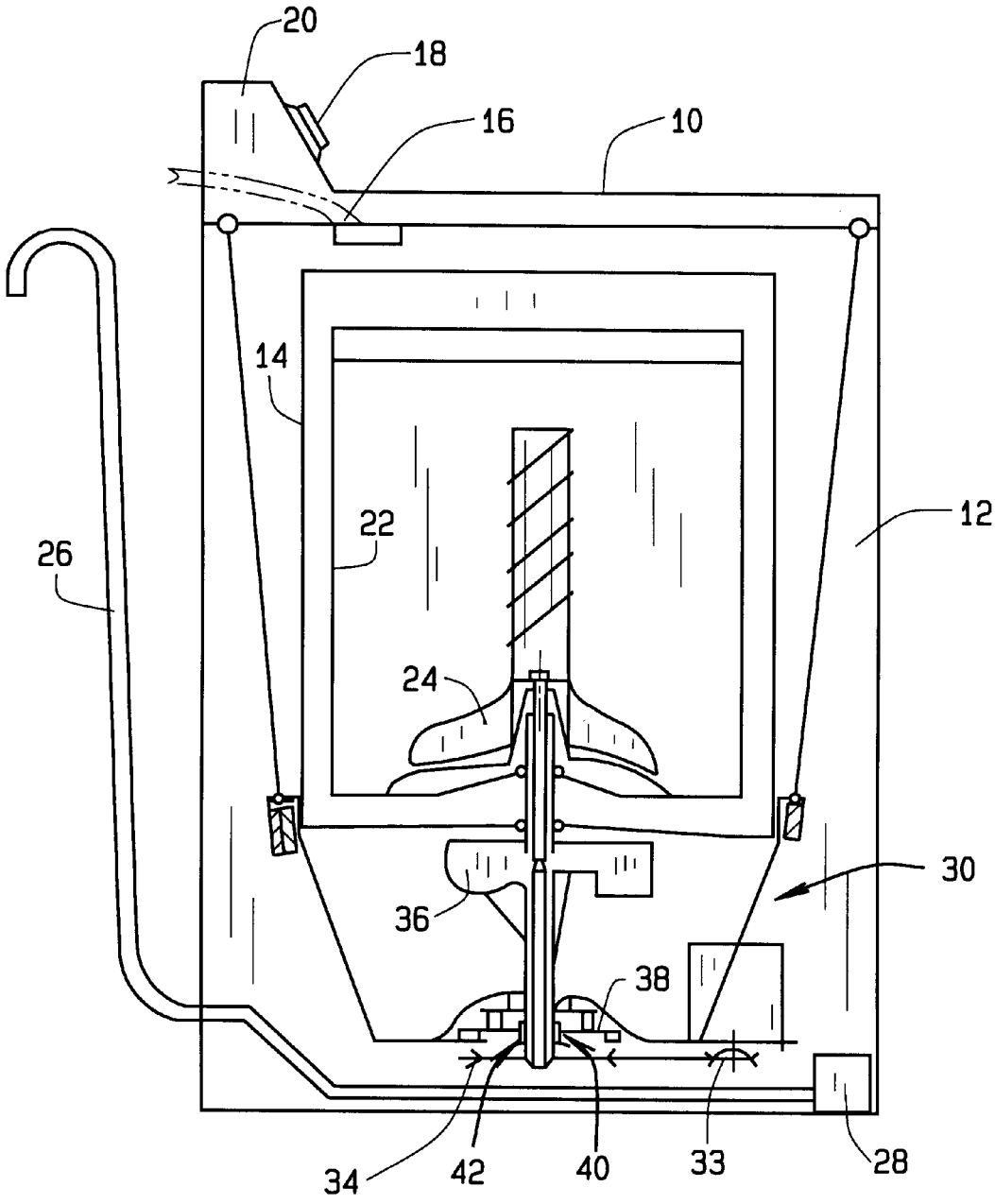
FIG. 1 PRIOR ART
FIG. 1 is a side view partially broken away of a washing machine.

FIG. 1 is a partially broken away view of a conventional washing machine 10, the construction and operation of which is well known in the art, and in which the present invention may be practiced. Washing machine 10 includes a cabinet housing 12 including a tub 14 adapted to be filled with wash water or rinse water through a fill tube 16 operatively coupled to an external water supply (not shown) to deliver water to tub 14 in response to manipulation of controls 18 located on a control panel 20 for user selection of desired machine cycles.

A clothes basket 22 is mounted within tub 14 and clothes disposed in clothes basket 22 are subjected to washing action by an oscillating agitator 24 located within clothes basket 22 during a wash or rinse cycle after introduction of water into tub 14. After each wash or rinse cycle agitation, clothes basket 22 is rotated at high speed in order to extract water from the clothes. The water is drained into a sump (not shown), and pumped to a drain 26 by a pump assembly 28.

Agitator 24 and clothes basket 22 are driven by a drive and motor assembly 30 including a single reversible electric drive motor 32, a clutch 33 and a pulley system 34 Drive motor 32 drives a centrifugally actuated wrap spring clutch (not shown) drivingly connected to a transmission 36. Transmission 36 is normally braked by a spring applied disk brake 38 engaged by a brake cam actuator assembly 40 so that agitator 24 rotates while clothes basket 22 remains stationary. A transmission pulley hub 42 is coupled to pulley system 34 and interfaces with a brake cam actuator (not shown).

When drive motor 32 rotates transmission pulley hub 42 in a first direction, transmission 36 actuates agitator 24 to oscillate while brake cam actuator assembly 40 engages disk brake 38 to prevent clothes basket 22 from rotating. When drive motor 30 is reversed to rotate transmission pulley hub 42 in a second direction, transmission pulley hub 42 and the wrap spring clutch actuates brake cam actuator assembly 40 and causes disk brake 38 to be released so that transmission pulley hub 42 spins transmission 36 coupled to clothes basket 22. Whenever clothes basket 22 is to be rotated for centrifugal extraction of liquid from clothes in clothes basket 22, brake cam actuator assembly 40 releases disk brake 38, allowing agitator 24 and clothes basket 22 to spin together.

Figure 2:
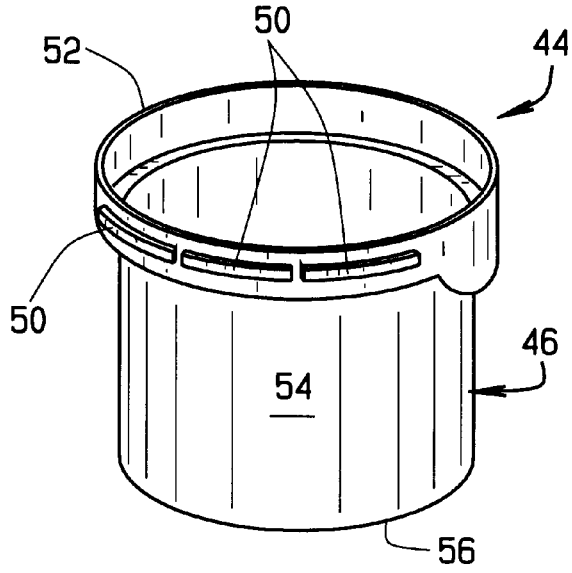
FIG. 2 is a perspective view of a washing machine overflow system.

FIG. 2 is a perspective view of washing machine overflow system 44 that may be used to prevent damage to a drive and motor assembly of a washing machine from overflow of a tub therein, such as for example, tub 14 of washing machine 10 (shown in FIG. 1). It is contemplated that a washing machine cabinet, such as cabinet housing 12 (shown in FIG. 1), includes overflow water paths or ports (not shown) to direct overflow water discharged from overflow system 44 away from washing machine 10 to a designated location, such as a floor drain (not shown). It is understood that the benefits of overflow system 44 accrue to all types of washing machines, and are not specific to any particular type of washing machine, such as exemplary washing machine 10.

Overflow system 44 includes a tub 46 and a plurality of overflow structures 50 located near a top 52 of tub 46. As a depth of water inside tub 46 approaches a pre-selected depth, water flows through overflow structures 50 and spills over overflow structures 50 to a portion of an exterior surface 54 of tub 46. Overflow water running down exterior surface 54 below overflow structures 50 may be diverted away from drive and motor assembly 30 by mounting tub 46 in washing machine 10 (shown in FIG. 1) so that exterior surface portion 54 is distanced from drive and motor assembly 30. From a bottom 56 of tub 46, water is directed to a floor (not shown) and away from drive and motor assembly 30. Thus, overflow system 44 prevents overflow water from overflowing top 52 of tub 46 and cascading components of drive and motor assembly 30 (shown in FIG. 1) by creating a controlled path for overflow water directing water away from drive and motor assembly 30.

In one embodiment, overflow structures 50 are formed integrally with tub 46. In alternative embodiments, overflow structures 50 are separately fabricated and mechanically or chemically bonded to tub 46 by known techniques. Also, while the illustrated embodiment includes three overflow structures 50 extending over approximately one third of a circumference of tub top 52, it is recognized that greater or fewer than three overflow structures 50 could be employed and span a greater or lesser portion of the circumference of tub top 52 without departing from the scope of the present invention.

Figure 3:
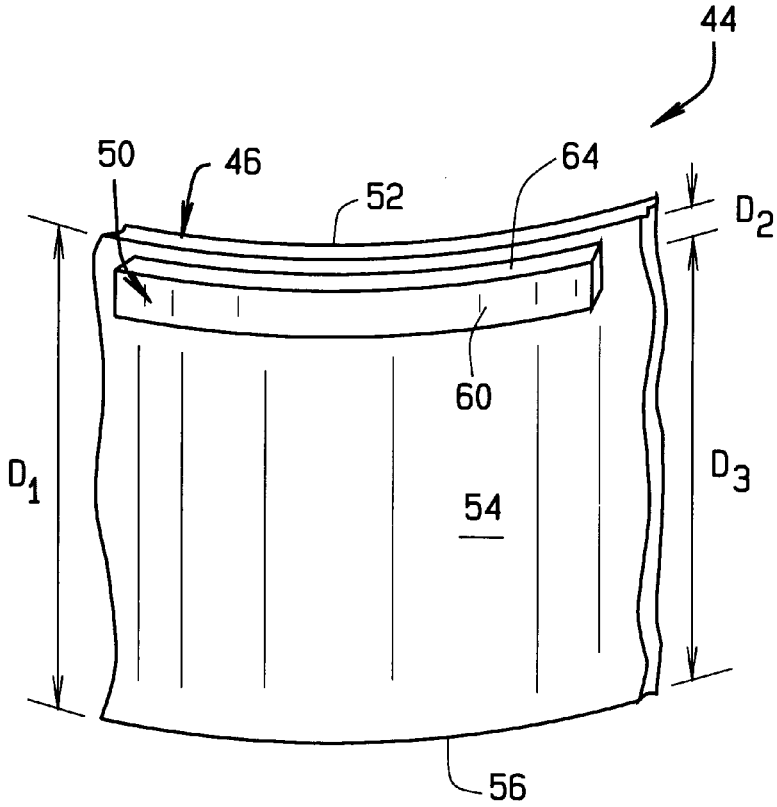
FIG. 3 is a partial perspective view of an exterior of the washing machine overflow system shown in FIG. 2.

FIG. 3 is a partial perspective view of overflow system 44 from outside tub 46 illustrating one overflow structure 50 integrally formed on a sidewall of tub 46 near tub top 52. A collector member 60 projects outwardly from tub exterior surface 54 and forms an enclosure (not shown in FIG. 3) to contain water scattered into overflow system 44 in normal use of washing machine 10. Tub 46 has an overall height $D_1$ from tub top 52 to tub bottom 56, and a top 64 of collector member 60 is distanced from top 52 of tub 46 by a pre-selected distance $D_2$ so that when a depth of water measured from tub bottom 56 approaches a depth $D_3$, water is discharged from tub 46 through open top 64 of collector member 60 to tub exterior surface 54.

Figure 4:
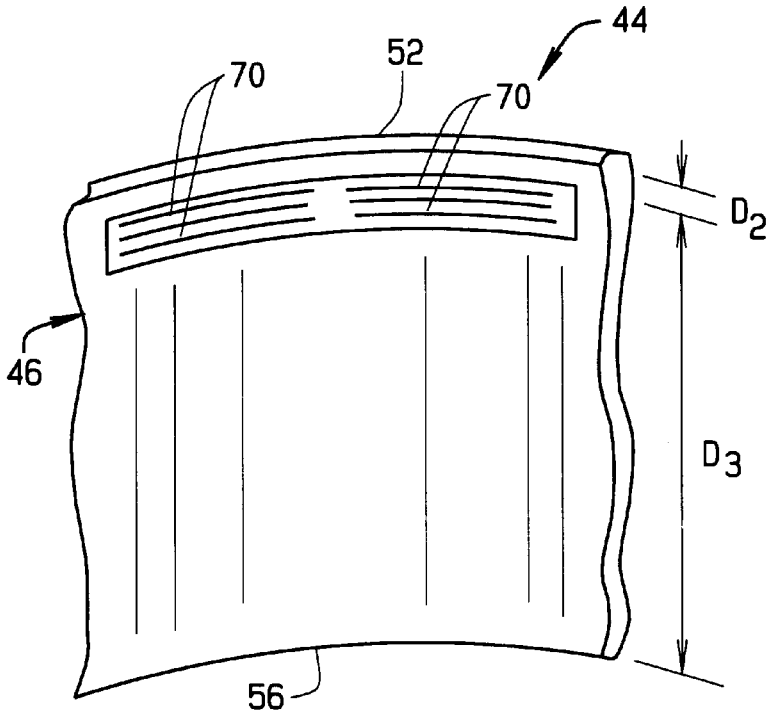
FIG. 4 is a partial perspective view of an interior of the washing machine overflow system shown in FIG. 2.

FIG. 4 is a partial perspective view of overflow system 44 from inside tub 46. Overflow system 44 includes a plurality of vents 70 extending substantially parallel to top 52 of tub 46 and spaced a distance greater than $D_2$ from tub top 52. Thus, as a depth of water measured from tub bottom 56 increases inside tub 46 and approaches $D_3$, water flows through vents 70 and into collector member 60 (shown in FIG. 3). While the illustrated vents are longitudinal slots, other types of vents could be employed within the scope of the invention, including but not limited to a plurality of relatively small and discrete openings forming a perforate surface.

Figure 5:
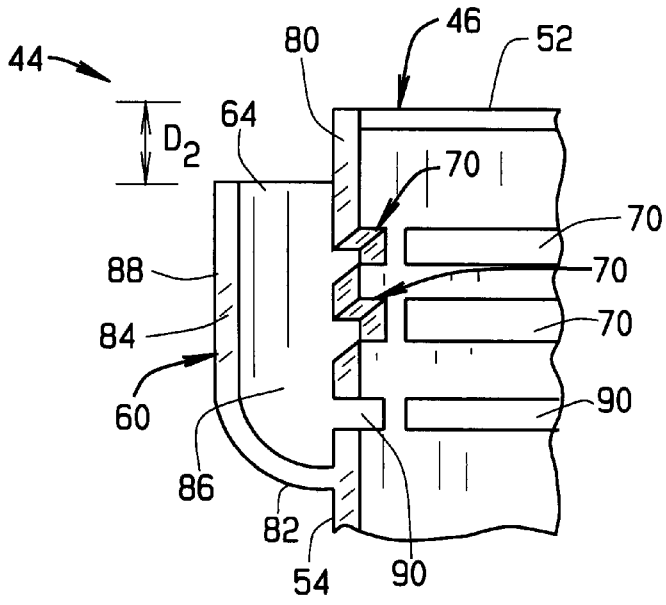
FIG. 5 is a partial cross sectional view of the overflow system shown in FIG. 2.

FIG. 5 is a partial cross sectional view of overflow system 44 including collector member 60 extending from a sidewall 80 of tub 46 and upwardly extending toward top 52 of tub 46. Collector member 60 includes a curved bottom portion 82 and a straight top portion 84 extending from bottom portion 82 and substantially parallel to tub exterior surface 54. Thus, collector member 60 forms an enclosure 86 between tub exterior surface 54 and collector member top portion 84 to contain scattered water passing into collector member 60 during normal use of washing machine 10. Open top 64 of collector member 60 is spaced a distance $D_2$ below top 52 of tub 46 so that overflow water is discharged from tub 46 when a depth of water inside tub 46 approaches depth $D_3$ (see FIG. 4) and prevents water from overflowing top 52 of tub 46. Rather, overflow water spills over top 52 of collector member 60, down an exterior surface 88 of collector member 60, and tub exterior surface portion 54 that directs water away from washing machine 10 (shown in FIG. 1).

Vents 70 extend through tub sidewall 80 above collector member bottom portion 82 and below collector member top portion 84. Vents 70 are louvered slots angled downwardly toward collector member bottom portion 82. Return passages 90 extend through tub sidewall 80 adjacent collector member bottom portion 82 and below vents 70. Return passages 90 allow scattered water collected in collector member enclosure 86 during washing machine agitator and spin cycles to return to tub 46. While return passages 90 are illustrated as longitudinal slots extending parallel to vents 70, return passages 86 embody other forms in alternative embodiments, including, but not limited to, a series of discrete openings forming a perforate surface.

Vents 70 and return passages 90 extend through tub sidewall 80 above an expected waterline (not shown) inside tub 46 during normal use of washing machine 10. Thus, during normal use of washing machine 10, overflow system collector member 60 serves primarily to collect and contain occasional scattering of water through vents 70 and return passages 90 into collector member enclosure 86 and return it to tub 46 through return passages 90. Collector member 60 also discharges air passing through vents 70 and return passages 90 through open collector member top 64.

As the water level inside tub 46 increases beyond the expected waterline and approaches overflow system 44, overflow water flows through return passages 90 and vents 70 into collector member enclosure 86 until the depth of water inside tub 46 approaches collector member top 64. Overflow water then passes over collector member top 64 to collector member exterior surface 88 and to tub exterior surface portion 54 away from drive and motor assembly 30 (shown in FIG. 1). Therefore, overflow system prevents uncontrolled overflowing of water over tub top 52, and damage to washing machine 10 from overflow water is avoided.

While the invention has been described in terms of various specific embodiments, those skilled in the art will recognize that the invention can be practiced with modification within the spirit and scope of the claims.

What is claimed is:

1. An overflow system for a washing machine comprising:

a tub comprising a sidewall;

at least one vent attached to said tub and extending through said sidewall; and at least one collector member attached to said sidewall adjacent said at least one vent and forming an enclosure adjacent said at least one vent, said collector member comprises a bottom portion attached to said sidewall below said at least one vent, a top portion extending from said bottom portion, said top portion attached to said sidewall above said at least one vent.

2. An overflow system in accordance with claim 1 wherein said collector member comprises a bottom portion, said overflow system further comprising a water return passage extending through said sidewall adjacent said bottom portion of said collector member.

3. An overflow system in accordance with claim 1 wherein said vent is integral to said tub.

4. An overflow system in accordance with claim 1 wherein said collector member is integral to said tub.

5. An overflow system in accordance with claim 1 wherein said vent and said collector member are integral.

6. An overflow system in accordance with claim 1 wherein said at least one vent comprises a louvered slot.

7. An overflow system in accordance with claim 1 wherein said tub comprises a top, said top portion of said collector member distanced from said tub top.

8. An overflow system in accordance with claim 7 wherein said at least one vent extends substantially parallel to said top.

9. An overflow system in accordance with claim 8 further comprising a second vent longitudinally aligned with said at least one vent, said collector member enclosing said at least one vent and said second vent.

10. An overflow system in accordance with claim 1 wherein said tub comprises an exterior surface, a portion of said collector member extends from said exterior surface and parallel to said exterior surface.

11. An overflow system in accordance with claim 1 wherein said tub further comprises an exterior surface, a top, and three collector members attached to said exterior surface adjacent said top.

12. A washing machine comprising:

a cabinet;

a tub located within said cabinet for containing wash and rinse water, said tub comprising a sidewall and an exterior surface;

a drive and motor assembly mounted beneath said tub;

a fill tube operatively coupled to an external water supply for supplying water to said tub; and an overflow system for preventing water from overflowing said tub and spilling onto said drive and motor assembly, said overflow system comprising:

a vent formed in and extending through said sidewall, said vent located relative to said drive and motor assembly in a portion of said sidewall such that water exiting said tub through said vent and running down said exterior surface will not spill onto said drive and motor assembly; and a collector member attached to said sidewall adjacent said vent and forming an enclosure adjacent said vent, said collector member further comprises a bottom portion, said overflow system further comprising a water return passage extending through said sidewall adjacent said bottom portion of said collector member.

13. A washing machine in accordance with claim 12 wherein said tub comprises a top and said collector member comprises a top portion attached to said sidewall below said vent, said top portion of said collector member distanced from said tub top.

14. A washing machine in accordance with claim 12 wherein said overflow system comprises a plurality of vents.

15. A washing machine in accordance claim 14 wherein said overflow system comprises at least one collector member attached to said sidewall adjacent a plurality of vents and forming an enclosure adjacent said plurality of vents.

16. A method of preventing overflow of a washing machine, the machine including a cabinet, a tub and a drive and motor assembly within the cabinet, and an overflow system including at least one vent extending through a tub sidewall, a collector member, and at least one return passage extending through the tub sidewall adjacent the collector member, said method comprising the steps of:

locating the at least one vent and the at least one collector member on the tub so that when water within the tub reaches a predetermined depth the water flows trough the at least one vent and into the collector member;

installing the tub into the cabinet so that the water spilling over the collector member is diverted away from the drive and motor assembly, thereby preventing damage to the drive and motor assembly during an overflow condition; and returning water collected in the collector member to the tub through the at least one return passage.

17. A method in accordance with claim 16 wherein the tub includes a top and the vent includes a louvered slot, the step locating the at least one vent further comprises the step of orienting the at least one vent and at least one collector member so that the slot extends parallel to and adjacent the top of the tub.

* * * * *

UNITED STATES PATENT AND TRADEMARK OFFICE

CERTIFICATE OF CORRECTION

PATENT NO. : 6,634,194 B1
DATED : October 21, 2003
INVENTOR(S) : Derek Lee Watkins It is certified that error appears in the above-identified patent and that said Letters Patent is hereby corrected as shown below:

Title page,
Item [22], Filed, delete "Feb. 8, 2000" and insert therefore -- Dec. 30, 1999 --.

Column 6,
Line 24, delete "trough" and insert therefor -- through --.

Signed and Sealed this

Fourth Day of May, 2004

JON W. DUDAS
*Acting Director of the United States Patent and Trademark Office*